US005628711A

United States Patent [19]

Boucher

[11] Patent Number: 5,628,711

[45] Date of Patent: May 13, 1997

[54] BICYCLE AND EXERCISE STAND

[76] Inventor: Leonard Boucher, 15 Willowbrook Ct. South West, Cartersville, Ga. 30120

[21] Appl. No.: 645,141

[22] Filed: May 13, 1996

[51] Int. Cl.[6] ..... A63B 21/00

[52] U.S. Cl. ..... 482/61; 434/61

[58] Field of Search ..... 482/61, 57, 60, 482/62, 63, 64, 65, 903; 434/61; D21/191, 194

[56] References Cited

U.S. PATENT DOCUMENTS

| | | | |
|---|---|---|---|
| D. 273,882 | 5/1984 | Bryne | D21/191 |
| D. 304,357 | 10/1989 | Maes | D21/194 |
| D. 304,963 | 12/1989 | Sargeant et al. | D21/194 |
| D. 334,038 | 3/1993 | Case | D21/194 |
| 3,572,758 | 3/1971 | Lee | 280/296 |
| 4,421,308 | 12/1983 | Nagy | 272/73 |
| 4,595,194 | 6/1986 | Previtali | 482/61 |
| 4,925,183 | 5/1990 | Kim | 482/61 |
| 4,976,424 | 12/1990 | Sargeant et al. | 482/61 |
| 5,145,478 | 9/1992 | Minoura | 482/61 |
| 5,433,681 | 7/1995 | Minoura | 482/61 |

*Primary Examiner*—Stephen R. Crow

[57] ABSTRACT

A bicycle and exercise stand (10) comprising: a stand base (12A) having a left bike support (12B) securely attached perpendicular to the stand base (12A). The left bike support (12B) supports the left distal end of a bicycle rear wheel axle (16ADA). A right bike support (12C) securely attached perpendicular to the stand base (12A) functions to support the right distal end of a bicycle rear wheel axle (16ADA). A friction means (14) is used to change the rolling resistance of a bicycle rear wheel (16A) to suite an user's needs.

1 Claim, 9 Drawing Sheets

BICYCLE AND EXERCISE STAND

BACKGROUND OF THE INVENTION

1. Field of the Invention

The present invention relates to bicycle exercise stand. More particularly, the present invention relates to a stand for holding the driving wheel of a bicycle clear of a floor and exerts frictional resistance on the drive wheel.

2. Description of the Prior Art

This invention relates to bicycle exercise stand for supporting a bicycle for stationary exercises, and more particularly to such a stand that accommodates bicycles of older designs not having quick release wheels. This includes single speed bicycles and bicycles having a multi-sprocket arrangement on one side.

Bicycle stands for supporting a bicycle for indoor exercises are widely known in the art. Usually the stands comprise a base with a pair of upright supports. The supports have a capture means to hold the bicycles rear axil off the ground and position the outside of the wheel to bear against a drag means. The drag means provides variable resistance as the user peddles. The prior art teaches a number of exercise stands that are adapted to a particular diameter wheel and a wheel width.

Numerous innovations for Bicycle and Exercise Stand have been provided in the prior art that are described as follows. Even though these innovations may be suitable for the specific individual purposes to which they address, they differ from the present invention as hereinafter contrasted.

In U.S. Pat. No. 5,433,681, titled Exercise Stand for a Bicycle, invented by Koji Minoura, a loading apparatus is mounted on a frame which supports a rear wheel of a bicycle. The loading apparatus includes a resistive force generator which has a rotary shaft connected to a drive drum which has a rotary shaft connected to a drive drum which is pressed against the tire of the rear wheel. The drive drum has a surface which contacts a plurality of circumferentially adjacent block patterns of a tire at each moment. The drive drum is also used as a fly wheel for providing the rear wheel of the bicycle with inertia force.

The present invention differs from the above described patented invention for the following reasons shaft devices project from upright supports that engage the rear axil ends to securely hold the rear axil within the uprights. The bicycle wheel is in contact with flywheel which has a belt drive connected to a magnetic resistance means. The resistance can be adjusted by turning a knob which in turn changes the alignment of the poles of the magnets providing changing resistance through increased or decreased eddy resistance in a rotating plate. The present invention engages the rear axil of a bicycle wheel by sliding the wheel axil ends into vertical slots in a pair of uprights. The uprights are adjustable to accommodate bicycle axil of different widths. The friction means of the present invention is a tension device that creates friction between the rear wheel of the bicycle and a roller attached to a base and upright.

In U.S. Pat. No. 4,421,308, titled Bicycle Exercise Stand, issued to Nagy comprises a bicycle stand for supporting the rear wheel of a bicycle in such a manner that the user can perform stationary bicycle exercises. The stand comprises a pair of upright, tubular members, and a pair of right angle pins for supporting the bicycle wheel axle such that its vertical and horizontal position on the stand can be adjusted to accommodate wheels of different diameters and axil widths. The pins are carried by the bicycle rear axle during normal street use.

The present invention differs from the above described patented invention for the following reasons a device for holding a bicycle to a pair of uprights comprises a right angle bracket which is fastened to the rear axil of a bicycle on both sides. The right angle bracket has downwardly extending pins which engage the uprights. There are provisions for adjusting the mechanism for varying widths of bicycles. The present invention has slots in the uprights which engage the protruding stubs of the bicycle's rear axil. The uprights of the present invention can be adjusted for width to accommodate bicycles of varying widths. In the patented invention friction is applied to the rear wheel by a roller which is held by an axil. The friction is changed by compressing the rear wheel of the bicycle against the roller by pushing down on the bicycle then tightening adjusting screws. In present invention friction is adjusted by a knob which changes the pressure applied by a spring to a roller. The spring pushed the roller upward against the rear wheel of the bicycle. The patented invention accommodates different widths of bicycles by adjustment of a pair of brackets mounted on the bicycle. The present invention adjusts width by sliding one of the uprights until the slots engage the rear wheel axil stubs.

In U.S. Pat. No. 3,572,758, titled Combination Bicycle Luggage Carrier and Bicycle Exercise Stand, invented by Robert E. Lee, a multipurpose device for use in connection with a bicycle, said device being adapted for use in one of its positions as a bicycle luggage carried and rotatable to a second position where it may serve as a bicycle stand to convert the bicycle into physical-exerciser device.

The present invention is a stand that accommodates different sizes of bicycles. The stand is independent of the bicycle, and the bicycle does not require modification to operate in the stand. The patented invention is a luggage carrier attached to the rear of a bicycle by an eccentric cam means. The Patented invention pivots about an offset pivot point to a position where the patented invention is horizontal and on the ground. The eccentric nature of the pivot brings resistance wheels into contact with the rear wheel of the bicycle. In present invention resistance is provided by a roller that is pushed against the rear wheel by a spring to provide resistance.

In Pat. No. Design 304,963, titled Bicycle Exercise Stand, invented by Bruce A. Sargeant, Robert Reasons, Mark Hoffenberg, Robert Walport, and James Lindsay, an ornamental design for a bicycle exercise stand, as shown and described.

The present invention differs from the above described patented invention because the patented invention is substantially different in the means of mounting the bicycle. The patented invention has provisions for a display screen or TV.

In Pat. No. Design 273,882, titled Bicycle Exercise Stand, invented by Richard M. Bryne, an ornamental design for a bicycle exercise stand, as shown and described.

The present invention differs from the above described patented invention for the following reasons the patented invention hold the bicycle upright by attaching the front fork to an adapter. The rear of the bicycle is clamped to an upright which fastens around the frame. Friction is provided by a roller means comprising two rotating wheels.

In Pat. No. Design 304,357, titled Bicycle Exercise Stand, invented by Sidney W. Maes, an ornamental design for a bicycle exercise stand, as shown and described.

The present invention differs from the above described patented invention for the following reasons the patented invention is not easily adaptable to different size bicycles.

An adjustment means is not disclosed to apply friction to the rear wheel by a roller held by a bracket. The front wheel is secured from rotation by a forward extending support means.

In Pat. No. Design 334,038, titled Bicycle Exercise Stand, invented by Robert A. Case, an ornamental design for a bicycle exercise stand, as shown and described.

The present invention differs from the above described patented invention for the following reasons the patented invention is not adjustable for different width bicycles. It is adjustable for different wheel diameters. The rear wheel is held by a fastening means. The present invention is adjustable for different width and diameter of wheels. The present invention secures the rear wheel to uprights by sliding the stub ends of the axil into receiving slots in the uprights.

Numerous innovations for Bicycle and Exercise Stand have been provided in the prior art that are adapted to be used. Even though these innovations may be suitable for the specific individual purposes to which they address, they would not be suitable for the purposes of the present invention as heretofore described.

SUMMARY OF THE INVENTION

Bicycles have been used for outdoor exercise for many years. Recently the use of purpose built indoor bicycles dedicated to exercising have been popular. A person desiring to ride for exercise on a consistent basis in spite of weather would need an indoor and outdoor bicycle. A need exists for an exercise stand to support outdoor bicycle that can accommodate a broad range of bicycles and quickly adapt to different bicycles such as might be found in a family.

The purpose of this invention is to provides an improved stand for supporting a bicycle while exercising. It comprises a base with uprights having slots that engage the protruding stubs of the rear axil to support the rear wheel of the bicycle. The slots accommodate bicycles having variable wheel diameters allowing the wheel to slid downwardly so the tire touches a friction roller. The uprights are adjustable to accommodate different width bicycles.

The types of problems encountered in the prior art are stand are adapted to a specific bicycle.

In the prior art, unsuccessful attempts to solve this problem were attempted namely vertical supports that are adjustable to accommodate different wheel diameters and widths. The prior art teachings require complex and tedious adjustments to adapt the invention to different diameters and widths. A need exists for an easily adaptable stand that accommodates a wide variety of bicycles. However, the problem was solved by the present invention because the one of the vertical supports is adjustable for width and each has a slot accepting the protruding stubs of the drive wheel axil. The slot allows the stand to accommodate different sized wheels.

Innovations within the prior art are rapidly being exploited to adapt to current style of bicycles such as mountain bicycles. However, these invention are not readily adaptable to older bicycles.

The present invention went contrary to the teaching of the art because it accommodates older bicycles not having quick release devices on the drive wheel and having the older style of rear axil. It also accommodates bicycles not having gears on the drive axil.

The present invention solved a long felt need for an exercise stand to fit older bicycles.

Accordingly, it is an object of the present invention to provide an exercise stand that adapts to old style bicycles having protruding stubs on the rear axil.

More particularly, it is an object of the present invention to provide an exercise stand that can be used with protruding stud style of rear axles.

In keeping with these objects, and with others which will become apparent hereinafter, one feature of the present invention resides, briefly stated, in a stand supporting a common bicycle for stationary exercising and riding.

When the bicycle and exercise stand is designed in accordance with the present invention, a means for stationary exercising using a bicycle is provided.

In accordance with another feature of the present invention, a stand having vertical members supports a bicycle upright there between by sliding the drive wheel axil stubs into vertical slots.

Another feature of the present invention is that the vertical supports are adjustable for width.

Yet another feature of the present invention is that frictional resistance is applied to the drive wheel by a roller.

Still another feature of the present invention is that the axil is held into the uprights by a pair of wing nuts on opposite distal ends the drive wheel axil.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—bicycle and exercise stand (10)
12—stand (12)
12A—stand base (12A)
12AA—stand base adjustment slot (12AA)
12AB—stand base adjustment slot counter bore (12AB)
12AC—stand base spring attachment (12AC)
12B—left bike support (12B)
12BA—left bike support upright (12BA)
12BAA—left bike support upright slot (12BAA)
12BAB—left bike support upright counter bore (12BAB)
12BAC—left bike support upright friction attachment means (12BAC)
12BB—left bike support filet (12BB)
12BC—adjusting means (12BC)
12BCA—adjusting means screw bracket (12BCA)
12BCB—adjusting means shaft (12BCB)
12BCC—adjusting means knob (12BCC)
12C—right bike support (12C)
12CA—right bike support upright (12CA)
12CB—right bike support horizontal support (12CB)
12CBA—right bike support fastening means (12CBA)
12CBAA—fastening means knob (12CBAA)
12CBAB—fastening means shaft (12CBAB)
12CBAC—fastening means nut (12CBAC)
12D—wing nut (12D)
14—friction means (14)
14A—friction means arm (14A)
14AA—friction means arm aperture (14AA)
14AB—friction means arm spring attachment means (14AB)
14AC—friction means arm flange (14AC)
14AD—friction means pivot (14AD)
14B—friction means resistance wheel (14B)
14BA—friction means resistance wheel roller (14BA)

14BB—friction means resistance wheel shaft (14BB)
14C—friction means resistance wheel spring (14C)
16—bicycle (16)
16A—bicycle rear wheel (16A)
16AA—bicycle rear wheel tire (16AA)
16ADA—bicycle rear wheel axle (16ADA)
16ADAA—bicycle rear wheel retaining nut (16ADAA)
16B—bicycle rear wheel insertion motion (16B)
18—fasteners (18)

BRIEF DESCRIPTION OF THE PREFERRED EMBODIMENT

DETAILED DESCRIPTION OF THE PREFERRED EMBODIMENT

Figure 1:
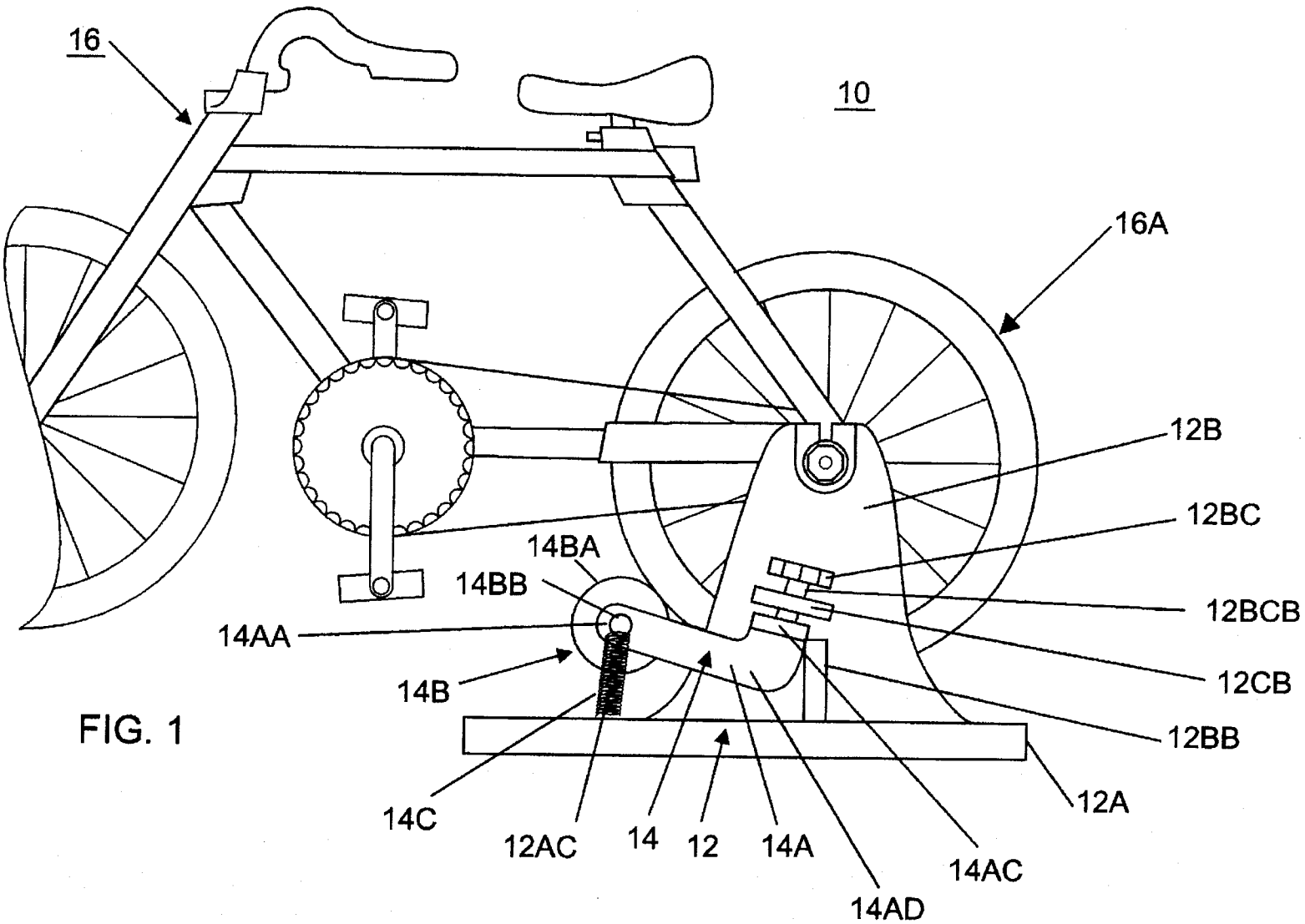
FIG. 1 is a left side view of a bicycle and exercise stand.

Firstly, referring to FIG. 1 is a left side view of a bicycle and exercise stand (10) exhibiting the following features: stand (12), stand base (12A), stand base spring attachment (12AC), left bike support (12B), left bike support filet (12BB), adjusting means (12BC), adjusting means screw bracket (12BCA), adjusting means shaft (12BCB), adjusting means knob (12BCC) friction means (14), friction means arm (14A), friction means arm aperture (14AA), friction means resistance wheel (14B), friction means resistance wheel roller (14BA), friction means resistance wheel shaft (14BB), friction means resistance wheel spring (14C), friction means pivot (14AD), bicycle (16), bicycle rear wheel tire (16AA), and bicycle rear wheel (16A)

A bicycle (16) having a bicycle rear wheel (16A) is supported by a bicycle and exercise stand (10) which comprises a stand (12) having a stand base (12A) securely attached at right angles to a left bike support (12B). The left bike support (12B) is securely attached to an inner distal end of a left bike support filet (12BB). A lower distal end of the left bike support filet (12BB) is securely attached to the stand base (12A). The left bike support (12B) functions to support the left distal end of a bicycle rear wheel (16A). The left bike support filet (12BB) functions to add stiffening to the left bike support (12B).

A friction means (14) is rotatably attached to the left bike support (12B) comprises a friction means arm (14A) having a friction means arm aperture (14AA) which is securely fastened to a proximal end of a friction means resistance wheel shaft (14BB). The distal end of the friction means resistance wheel shaft (14BB) is rotatably attached to a friction means resistance wheel (14B).

The friction means arm (14A) is orthogonally attached to a friction means arm flange (14AC). The left bike support (12B) is securely attached to an adjusting means screw bracket (12BCA) by a left bike support upright friction attachment means (12BAC). The left bike support upright friction attachment means (12BAC) functions to support an adjusting means (12BC).

The adjusting means screw bracket (12BCA) is rotationally attached to an adjusting means shaft (12BCB) at a mid-distal end. One distal end of the adjusting means shaft (12BCB) is securely attached to an adjusting means knob (12BCC). The opposite distal end bears against the friction means arm flange (14AC). Turning the knob (12BCC) in a clockwise direction functions to increase the resistance of the roller against the bicycle rear wheel (16A). Turning the knob (12BCC) in a counter clockwise direction functions to decrease the resistance of the roller against the bicycle rear wheel (16A). The knob (12BCC) functions to change peddling resistance by causing proximal end of the friction means arm (14A) to pivot about the friction means pivot (14AD). The distal end of the friction means arm (14A) pivots in the opposite direction causing the roller to change the pressure applied to the bicycle rear wheel (16A).

The stand base (12A) further comprises a stand base spring attachment (12AC) which is securely attached to one distal end of a friction means resistance wheel spring (14C). The opposite distal end of the friction means resistance wheel spring (14C) is securely attached to the friction means arm (14A). The friction means resistance wheel spring (14C) functions to apply pressure to the friction means arm (14A) which in turn pushed the friction means resistance wheel (14B) against the bicycle rear wheel tire (16AA). The pressure of the friction means resistance wheel (14B) against the bicycle rear wheel tire (16AA) functions to change the rotational resistance of the bicycle rear wheel (16A).

The stand (12) is constructed from a group of materials consisting of metal, metal ahoy, plastic, plastic composites, fiberglass, carbon-graphite, and wood.

Figure 2:
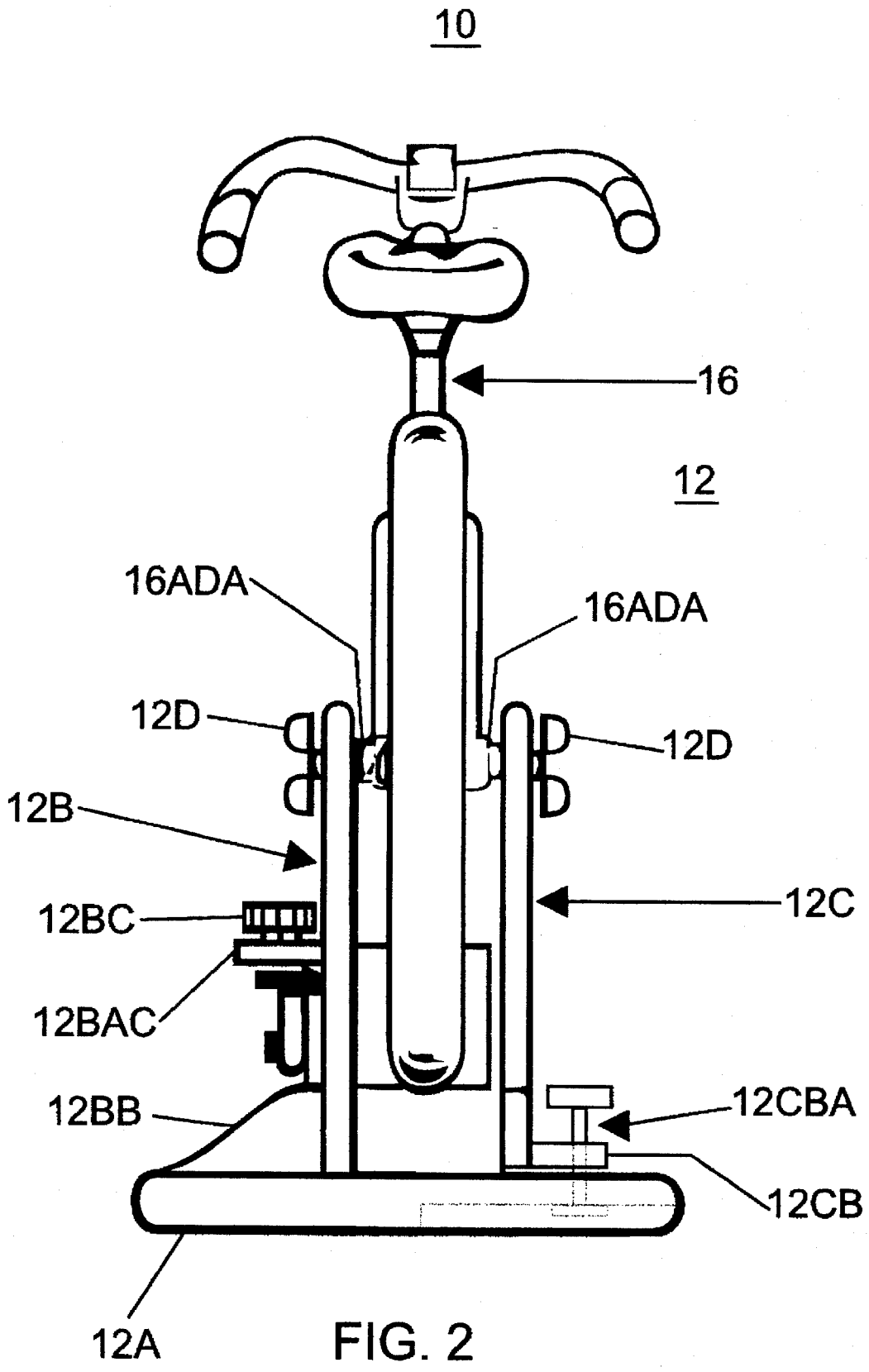
FIG. 2 is a rear view of a bicycle and exercise stand.

Secondly referring to FIG. 2 which is a rear view of a bicycle and exercise stand (10) exhibiting the following features: stand (12), stand base (12A), left bike support (12B), upright friction attachment means (12BAC), left bike support filet (12BB), adjusting means (12BC), right bike support (12C), right bike support fastening means (12CBA), wing nut (12D), bicycle (16), and bicycle rear wheel axle 16ADA).

A bicycle (16) having a bicycle rear wheel (16A) is supported by a bicycle and exercise stand (10) comprises the stand (12) having the stand base (12A) securely attached at right angles to the left bike support (12B). The left bike support (12B) is securely attached to an inner distal end of the left bike support filet (12BB). A lower distal end of the left bike support filet (12BB) is securely attached to the stand base (12A). The left bike support (12B) functions to support a left distal end of a bicycle rear wheel axle (16ADA). The left bike support filet (12BB) functions to add stiffening to the left bike support (12B).

The left bike support the upright fiction attachment means (12BAC) functions to support an adjusting means (12BC).

A right bike support (12C) is movable attached to the stand (12) by a right bike support fastening means (12CBA) .The right bike support (12C) functions to support the left distal end of the bicycle rear wheel (16A). A right bike support horizontal support (12CB) functions to add stiffening to the right bike support (12C). The right bike support (12C) supports a right end of a bicycle rear wheel axle (16ADA).

A wing nut (12D) securely and removably fastens the bicycle (16) to the right bike support (12C) and left bike support (12B).

Figure 3:
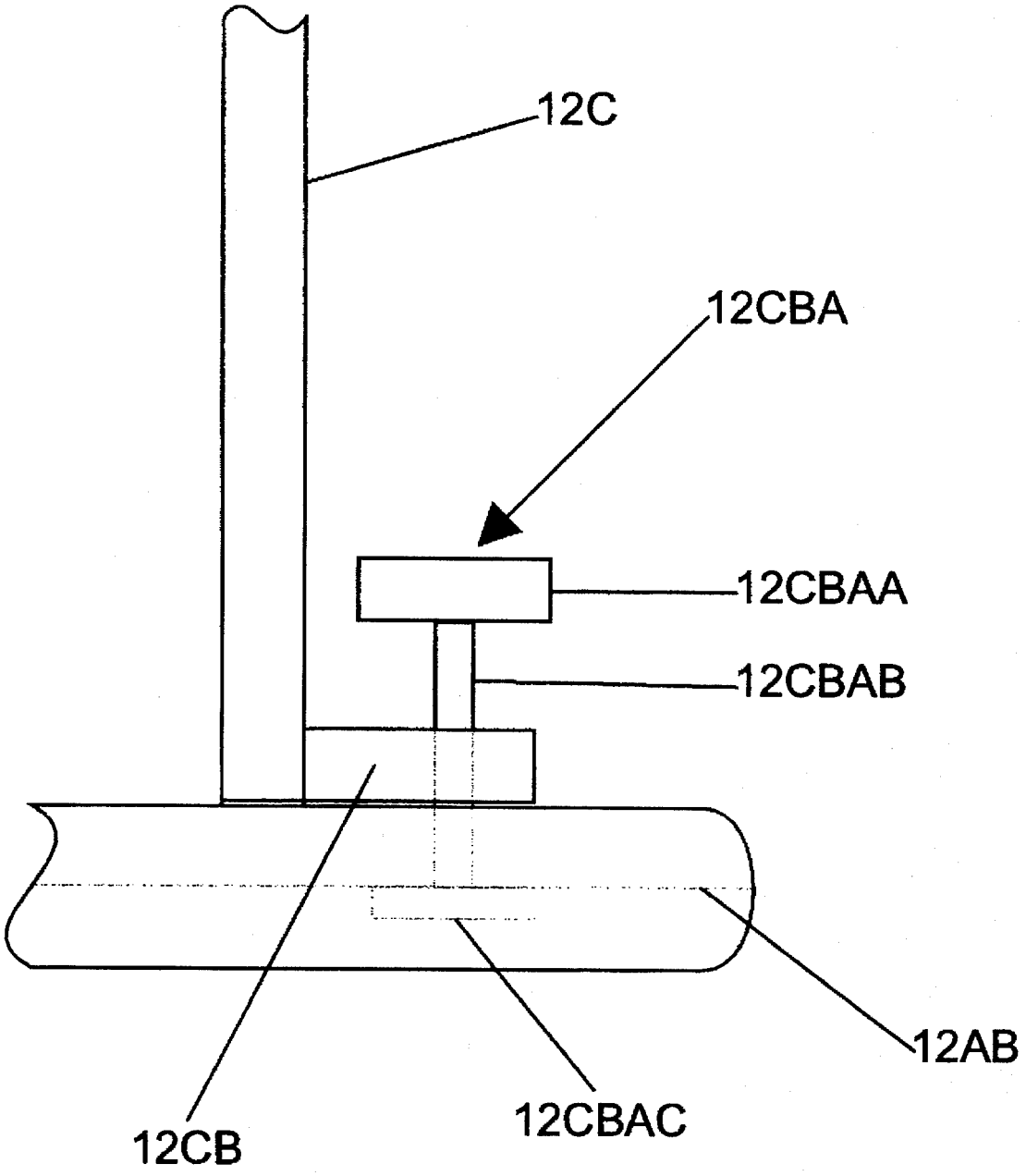
FIG. 3 is enlarged view of the right bike support fastening means showing the fastening means knob, fastening means shaft, and fastening means nut.

Referring now to FIG. 3 which is an enlarged view of the right bike support fastening means (12CBA) having the following features: stand base adjustment slot (12AA), stand base adjustment slot counter bore (12AB), fastening means knob (12CBAA), fastening means shall (12CBAB), and fastening means nut (12CBAC).

The right bike support (12C) comprises a right bike support horizontal support (12CB) projecting horizontally at a base. The right bike support horizontal support (12CB) functions to provide stiffness to the right bike support (12C). The right bike support horizontal support (12CB) is rotationally attached to a right bike support fastening means (12CBA) which comprises a fastening means knob (12CBAA) Securely attached to an upper distal end of a fastening means shaft (12CBAB). The fastening means shaft (12CBAB) is rotationally attached to a fastening means nut (12CBAC). The fastening means shaft (12CBAB) fits through a stand base adjustment slot (12AA) in the stand base (12A). The fastening means nut (12CBAC) slides in a stand base adjustment slot counter bore (12AB). To adjust the right bike support (12C) the fastening means knob (12CBAA) is rotated to loosen the right bike support horizontal support (12CB) from the stand base (12A). The right bike support (12C) is adjusted until a bicycle rear wheel hub (16AD) can pass between the right bike support (12C) and the left bike support (12B).

Figure 4:
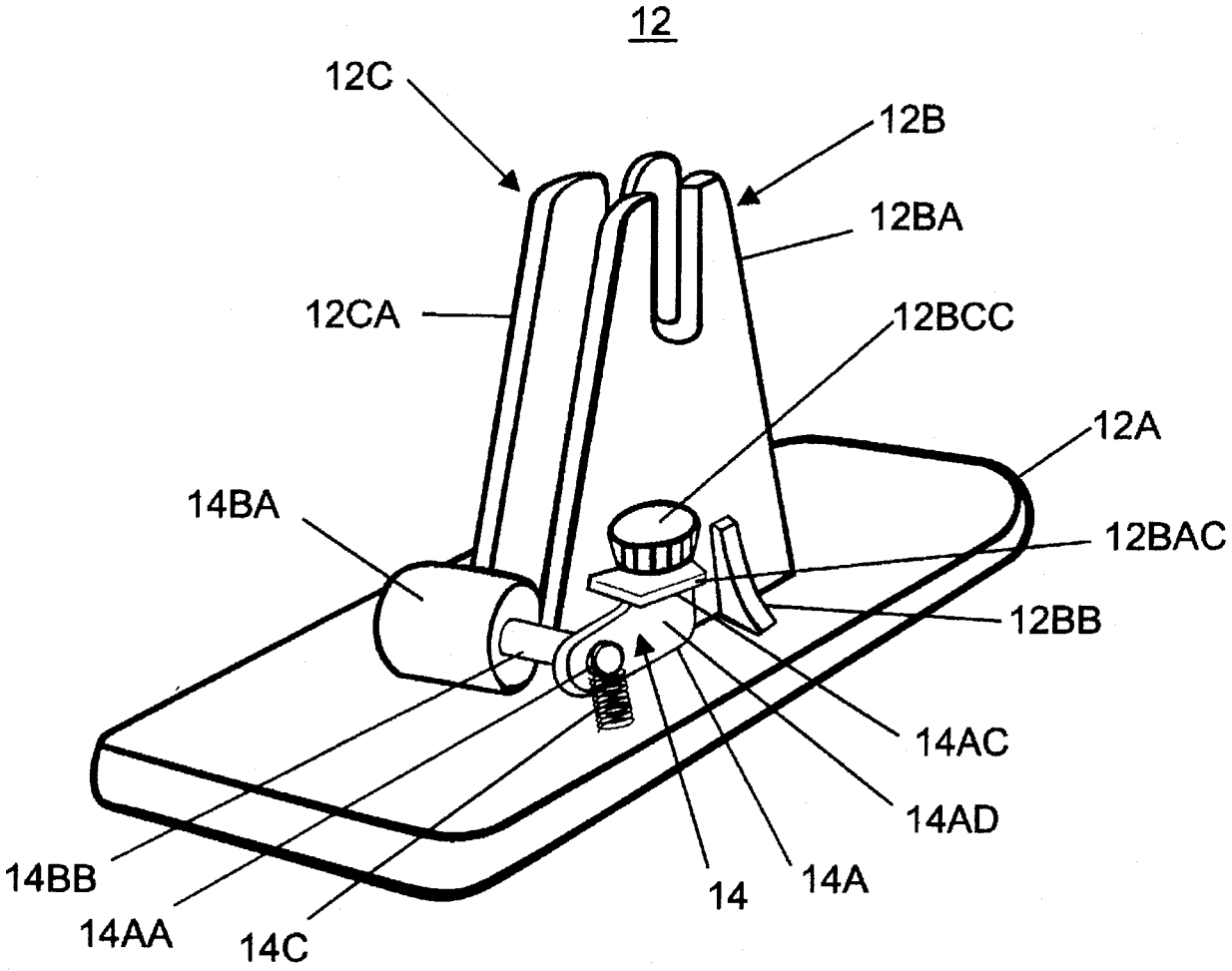
FIG. 4 is a left forward view of a stand showing friction means.

Now referring to FIG. 4 is a left forward view of a stand (12) showing a friction means (14) having the following features: stand base (12A), left bike support (12B), left bike support upright (12BA), left bike support filet (12BB), adjusting means (12BC), right bike support (12C), right bike support upright (12CA), friction means (14), friction means arm (14A), friction means arm aperture (14AA), friction means arm flange (14AC), friction means resistance wheel roller (14BA), friction means resistance wheel shaft (14BB), friction means pivot (14AD), and friction means resistance wheel spring (14C).

The stand (12) comprises: the stand base (12A) which is securely attached at right angles to a left bike support (12B). The left bike support (12B) is securely attached to an inner distal end of a left bike support filet (12BB). A lower distal end of the left bike support filet (12BB) is securely attached to the stand base (12A). The left bike support (12B) functions to support the left distal end of a bicycle rear wheel (16A). The left bike support filet (12BB) functions to add stiffening to the left bike support (12B).

A friction means (14) is rotatably attached to the left bike support (12B) comprises a friction means arm (14A) having a friction means arm aperture (14AA) which is securely fastened to a proximal end of a friction means resistance wheel shaft (14BB). The distal end of the friction means resistance wheel shaft (14BB) is rotatably attached to a friction means resistance wheel (14B). The friction means arm (14A) is orthogonally attached to a friction means arm flange (14AC).

The left bike support (12B) is securely attached to an adjusting means screw bracket (12BCA) by a left bike support upright friction attachment means (12BAC). The left bike support upright friction attachment means (12BAC) functions to support an adjusting means (12BC).

Turning the knob (12BCC) in a clockwise direction functions to increase the resistance of the roller against the bicycle rear wheel (16A). Turning the knob (12BCC) in a counter clockwise direction functions to decrease the resistance of the roller against the bicycle rear wheel (16A). The knob (12BCC) functions to change peddling resistance by causing proximal end of the friction means arm (14A) to pivot about the fiction means pivot (14AD). The distal end of the friction means arm (14A) pivots in the opposite direction causing the roller to change the pressure applied to the bicycle rear wheel (16A). The friction means resistance wheel spring (14C)

The stand base (12A) further comprises a stand base spring attachment (12AC) which is securely attached to one distal end of a friction means resistance wheel spring (14C). The opposite distal end of the friction means resistance wheel spring (14C) is securely attached to the friction means arm (14A). The friction means resistance wheel spring (14C) functions to apply pressure to the friction means arm (14A) which in turn pushed the friction means resistance wheel (14B) against the bicycle rear wheel tire (16AA). The pressure of the friction means resistance wheel (14B) against the bicycle rear wheel tire (16AA) functions to change the rotational resistance of the bicycle rear wheel (16A) making which in turn changes the pedaling resistance.

Figure 5:
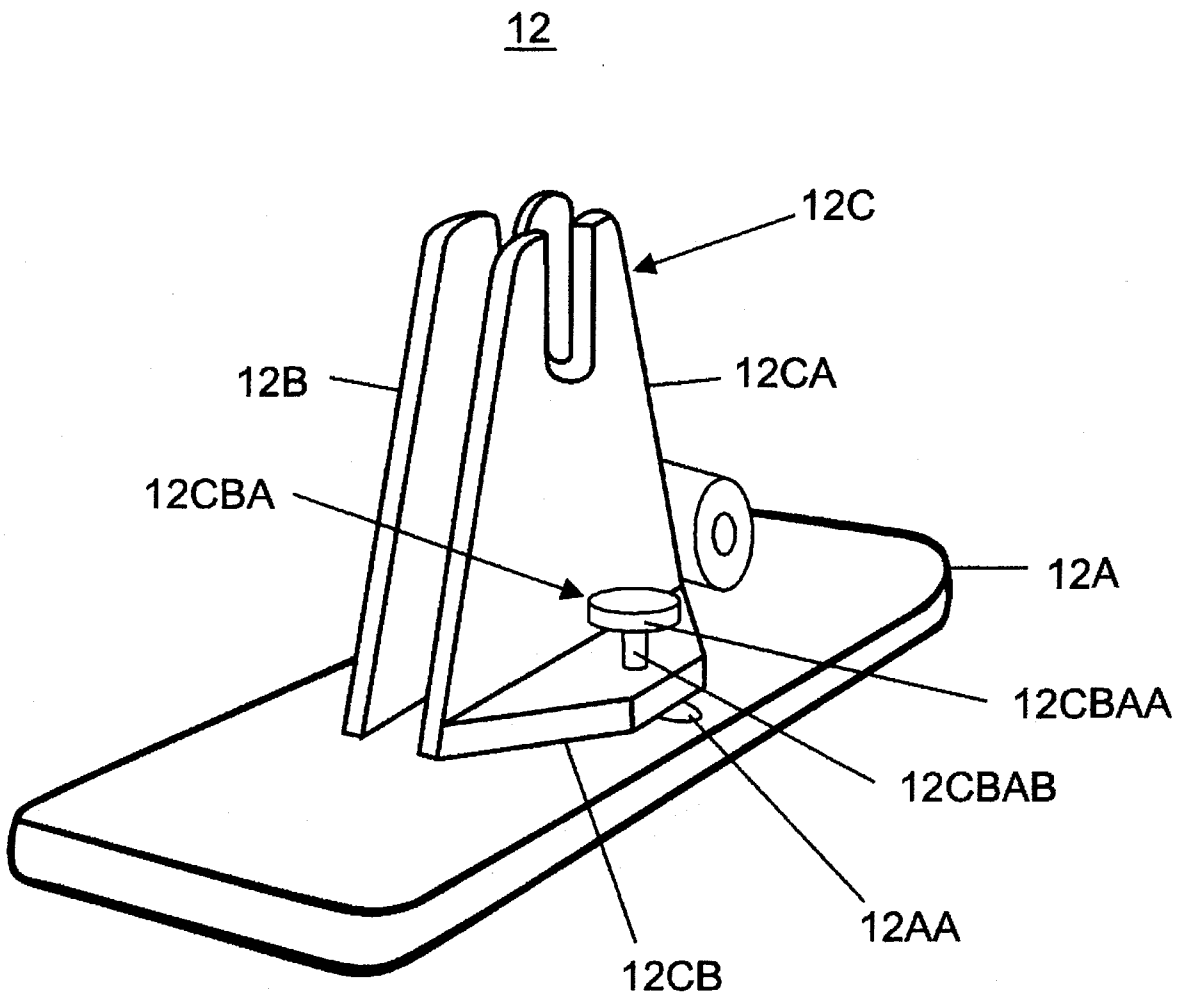
FIG. 5 is a rear detail view of a right bike support showing a right bike support upright and right bike support fastening means.

Referring now to FIG. 5 which is a right rear view of a stand (12) exhibiting features: left bike support (12B), right bike support (12C), right bike support upright (12CA), right bike support horizontal support (12CB), right bike support fastening means (12CBA), fastening means knob (12CBAA), fastening means shaft (12CBAB), fastening means nut (12CBAC), The left bike support (12B) is fastened perpendicularly to a stand base (12A) and functions to support the left distal end of the bicycle rear wheel axle (16ADA).

The right bike support (12C) comprises a right bike support horizontal support (12CB) projecting horizontally at a base. The right bike support horizontal support (12CB) functions to provide stiffness to the right bike support (12C). The right bike support horizontal support (12CB) is rotationally attached to a right bike support fastening means (12CBA) which comprises a fastening means knob (12CBAA) Securely attached to an upper distal end of a fastening means shaft (12CBAB). The fastening means shaft (12CBAB) is rotationally attached to a fastening means nut (12CBAC). The fastening means shaft (12CBAB) fits through a stand base adjustment slot (12AA) in the stand base (12A). The fastening means nut (12CBAC) slides in a stand base adjustment slot counter bore (12AB). To adjust the right bike support (12C) the fastening means knob (12CBAA) is rotated to loosen the right bike support horizontal support (12CB) from the stand base (12A). The right bike support (12C) is adjusted until the bicycle rear wheel hub (16AD) can pass between the right bike support (12C) and the left bike support (12B) with the stub of the bicycle rear wheel axle (16ADA).

Figure 6:
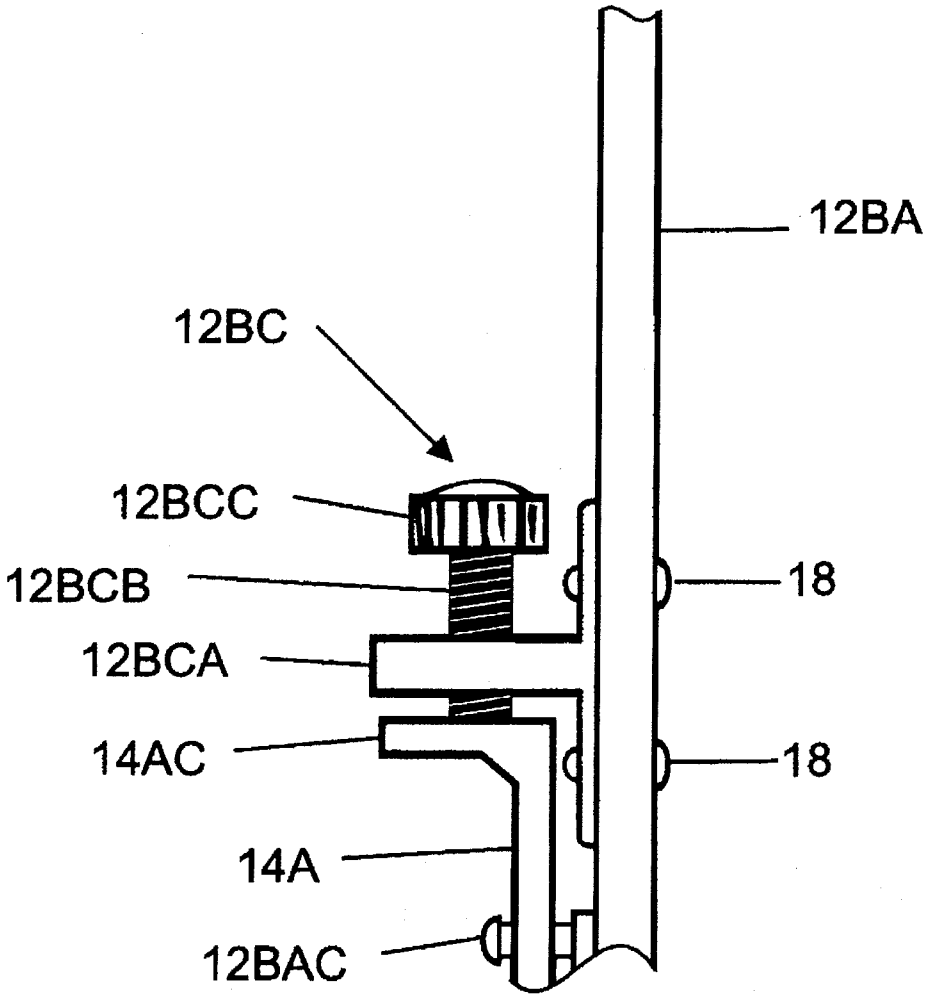
FIG. 6 is an enlarged rear view of the adjusting means.

Now referring to FIG. 6 which is an enlarged rear view of the adjusting means (12BC) exhibiting the following features: left bike support upright friction attachment means (12BAC), adjusting means (12BC), adjusting means screw bracket (12BCA), adjusting means shaft (12BCB), adjusting means knob (12BCC), friction means arm flange (14AC), friction means arm (14A), fasteners (18)

Figure 7:
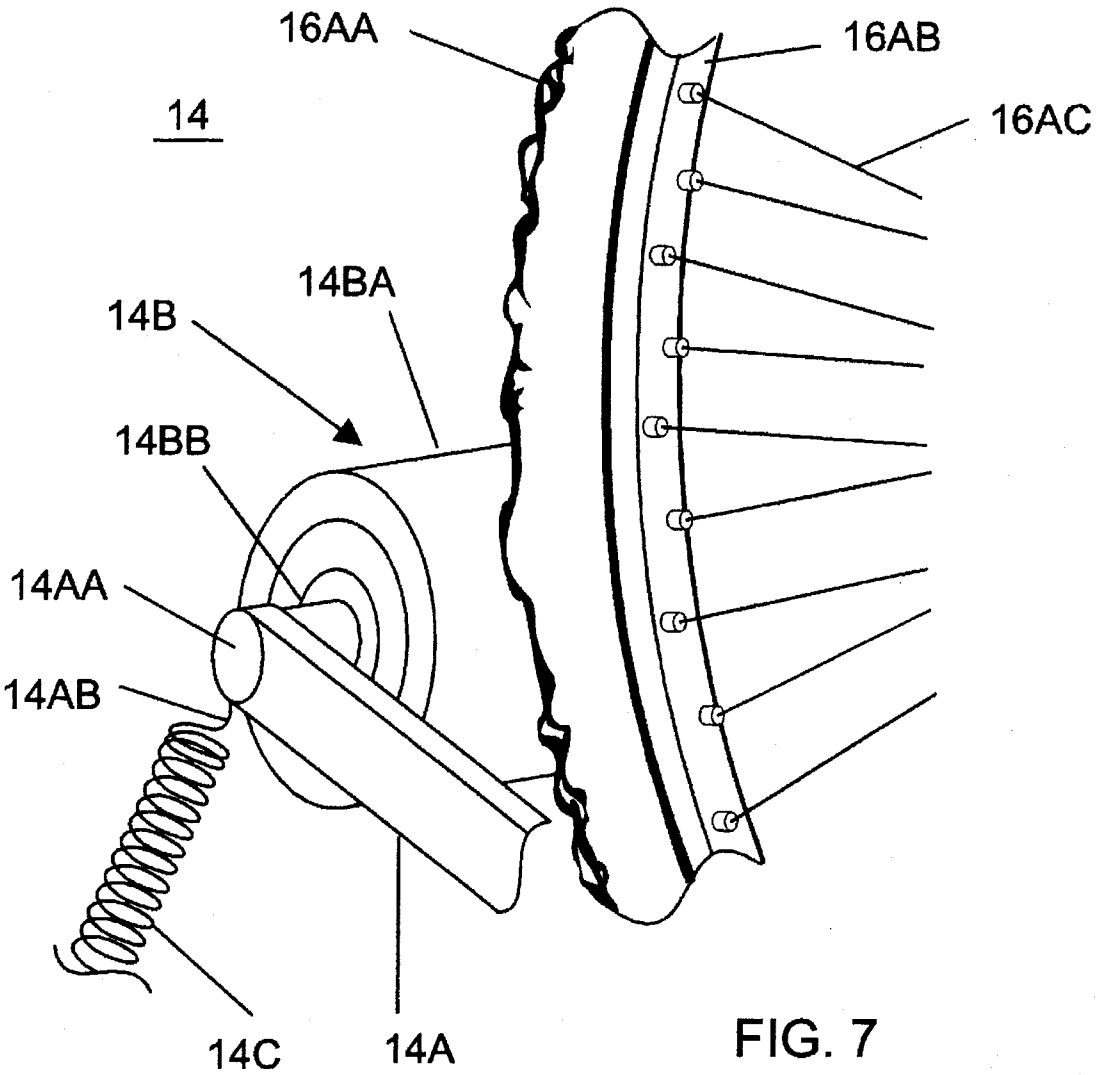
FIG. 7 is an enlarged view of the friction means.

The adjusting means (12BC) comprises the left bike support upright friction attachment means (12BAC) which is securely attached to the left bike support upright (12BA) by at least two fasteners (18). The left bike support upright friction attachment means (12BAC) is rotationally attached to an adjusting means shaft (12BCB). an upper distal end of the adjusting means shaft (12BCB) is securely attached to the adjusting means knob (12BCC). The lower distal end of the adjusting means shaft (12BCB) bears against a friction means ann flange (14AC). The friction means arm flange (14AC) is perpendicularly attached to a friction means arm (14A). Referring to FIG. 7 which is an enlarged view of the friction means (14) exhibiting following features: friction means (14), friction means arm (14A), friction means arm aperture (14AA), friction means arm spring attachment means (14AB), friction means resistance wheel (14B), friction means resistance wheel roller (14BA), friction means resistance wheel shaft (14BB), friction means resistance wheel spring (14C), bicycle rear wheel tire (16AA), bicycle rear wheel rim (16AB), and bicycle rear wheel spoke (16AC).

The friction means (14) comprises the friction means arm (14A) pivotly attached to left bike support upright (12BA) by the friction means pivot (14AD). The friction means arm (14A) comprises the friction means arm aperture (14AA) which securely fastens a proximal end of the friction means resistance wheel shaft (14BB). The distal end of the friction means resistance wheel shaft (14BB) is rotatably attached to the friction means resistance wheel (14B). The friction means resistance wheel (14B) creates resistance for the user when it is forced against the bicycle rear wheel tire (16AA) and less resistance for the user when it is relaxed.

The friction means resistance wheel spring (14C) is securely attached to the friction means arm (14A). The friction means resistance wheel spring (14C), under tension, functions to apply pressure to the friction means arm (14A) which in turn pushes the friction means arm flange (14AC) against the adjusting means shaft (12BCB), which limits its travel. The friction means resistance wheel spring (14C) functions to keep the friction means arm flange (14AC) against the adjusting means shaft (12BCB).

Figure 8:
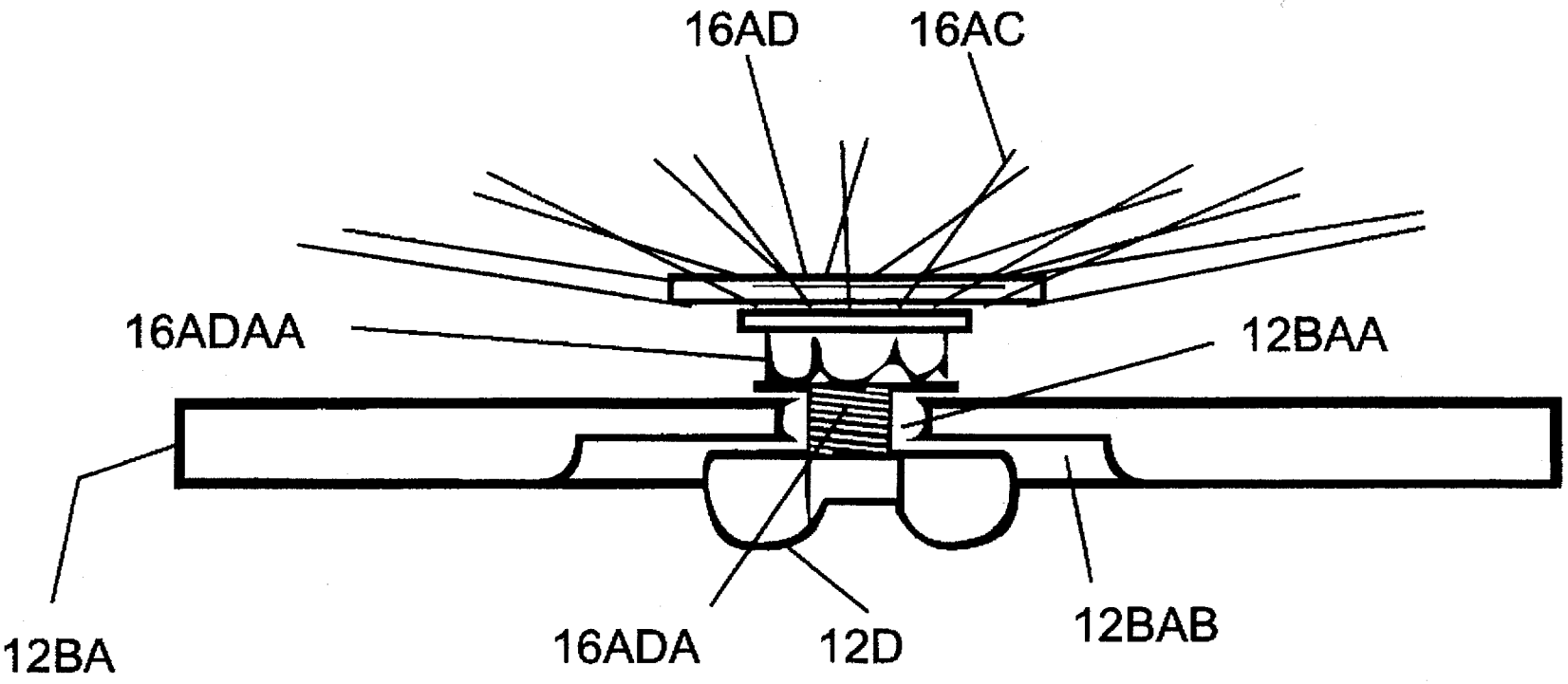
FIG. 8 is a top enlarged view of the left bike support upright showing the left bike support upright slot and left bike support upright counter bore.

Referring now to FIG. 8 which is a top enlarged view of the left bike support upright (12BA) exhibiting the following features: left bike support upright (12BA), left bike support upright slot (12BAA), left bike support upright counter bore (12BAB), wing nut (12D), bicycle rear wheel axle (16ADA), and bicycle rear wheel retaining nut (16ADAA).

The left bike support upright (12BA) comprises the left bike support upright slot (12BAA) and a left bike support upright counter bore (12BAB). The left bike support upright slot (12BAA) is sized to accept a proximal end of the bicycle rear wheel axle (16ADA). The wing nut (12D) is rotationally fastened to the proximal end of the bicycle rear wheel axle (16ADA). When the wing nut (12D) is tightened the bicycle rear wheel retaining nut (16ADAA) is brought into contact with the inside of the left bike support upright (12BA) further tightening brings the wing nut (12D) into contact with the bottom of the left bike support upright counter bore (12BAB) which securely and removably fastens the bicycle rear wheel axle (16ADA) to the left bike support upright (12BA).

Figure 9:
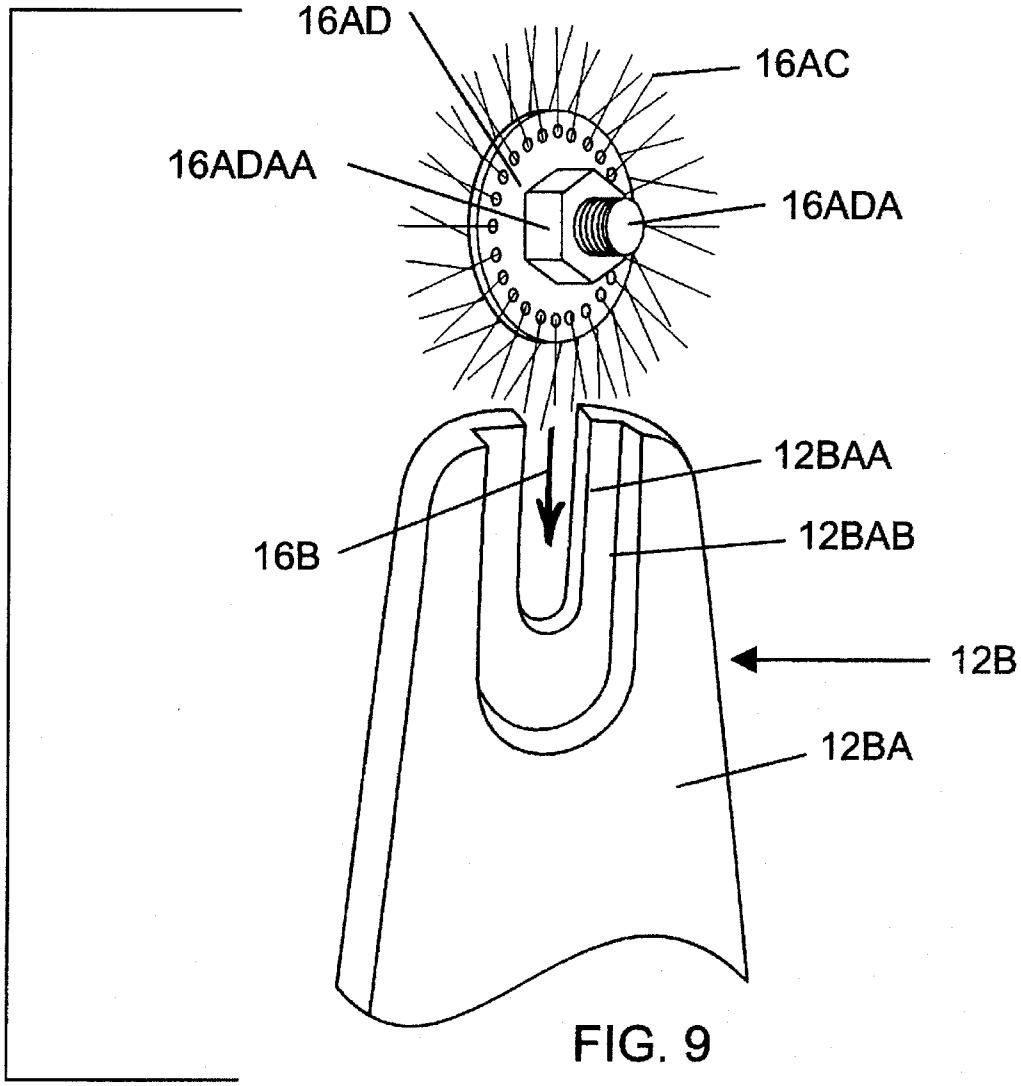
FIG. 9 is enlarged side view of left bike support upright slot showing the left bike support upright counter bore, left bike support upright friction attachment means, bicycle rear wheel, bicycle rear wheel axle, bicycle rear wheel retaining nut, and bicycle rear wheel insertion motion.

Finally referring to FIG. 9 which is an enlarged side view of the left bike support upright slot (12BAA) exhibiting the following features: left bike support upright (12BA), left bike support upright slot (12BAA), left bike support upright counter bore (12BAB), bicycle rear wheel axle (16ADA), bicycle rear wheel retaining nut (16ADAA), and bicycle rear wheel insertion motion (16B).

The left bike support upright (12BA) comprises the left bike support upright slot (12BAA) and the left bike support upright counter bore (12BAB). The bicycle rear wheel axle (16ADA) is inserted downward as shown by a bicycle rear wheel insertion motion (16B), the bicycle rear wheel retaining nut (16ADAA) is positioned on the inside of the left bike support upright (12BA).

It will be understood that each of the elements described above, or two or more together, may also find an useful application in other types of constructions differing from the type described above.

While the invention has been illustrated and described as embodied in a Bicycle and Exercise Stand, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bicycle and exercise stand (10) comprising:

A) a stand (12) functioning to support a bicycle (16) in an upright position and provide adjustable peddling resistance for an user, the stand (12) comprises a stand base (12A) which comprises:

B) a left bike support upright (12BA) securely attached perpendicular to the stand base (12A), the left bike support upright (12BA) functions to support a left distal end of a bicycle rear wheel axle (16ADA), the left bike support upright (12BA) comprises:

I) a friction means (14) rotationally attached to the left bike support upright (12BA), the friction means (14) comprises a friction means arm (14A) pivotly attached to the left bike support upright (12BA) by a friction means pivot (14AD), one distal end of a friction means arm (14A) securely fastened to a friction means resistance wheel (14B), the friction means resistance wheel (14B) comprises a friction means resistance wheel shaft (14BB) which is securely fastened on a proximal distal end to the friction means arm (14A) at a friction means arm aperture (14AA), the friction means resistance wheel shaft (14BB) is rotationally attached to a friction means resistance wheel roller (14BA), the friction means resistance wheel spring (14C) is securely attached at one distal end to a friction means arm spring attachment means (14AB), an opposite distal end of the friction means resistance wheel spring (14C) is attached to a stand base spring attachment (12AC) which is securely attached to the stand base (12A), the friction means resistance wheel spring (14C) functions as a return means for the friction means arm (14A), a friction means arm flange (14AC) is perpendicularly and securely attached to the friction means arm (14A), the friction means am flange (14AC) functions as beating surface for a lower distal end of an adjusting means shaft (12BCB), the upper distal end of the adjusting means shaft (12BCB) is securely attached to an adjusting means knob (12BCC), the adjusting means shaft (12BCB) is rotationally attached to an adjusting means screw bracket (12BCA), the adjusting means screw bracket (12BCA) is securely attached to the left bike support upright (12BA), the friction means (14) functions to change the rolling resistance of a bicycle rear wheel (16A), ii) a left bike support upright slot (12BAA) is positioned at a top distal end of the left bike support upright (12BA), the left bike support upright slot (12BAA) is complimentary sized to fit a left distal end of a bicycle rear wheel axle (16ADA), the left bike support upright (12BA) further comprises a left bike support upright counter bore (12BAB) surrounding the left bike support upright slot (12BAA), the left bike support upright slot (12BAA) and left bike support upright counter bore (12BAB) cooperating to accept a wing nut (12D), the wing nut (12D) functions to secure the bicycle rear wheel axle (16ADA) to the left bike support upright slot (12BAA), B) a right bike support (12C) is slidably, and adjustably attached perpendicular to the stand base (12A), the right bike support (12C) functions to support a right distal end of the bicycle rear wheel axle (16ADA), the right bike support (12C) comprises a right bike support upright (12CA) having a right bike support horizontal support (12CB), the right bike support horizontal support (12CB) functions to add rigidity to the right bike support upright (12CA), a right bike support fastening means (12CBA) having a fastening means shaft (12CBAB) which is rotationally attached, at a midpoint, to the right bike support horizontal support (12CB), the fastening means shaft (12CBAB) comprises a fastening means knob (12CBAA) which is securely fastened to an upper distal end of the fastening means shaft (12CBAB), the fastening means shaft (12CBAB) is rotationally attached at a lower distal end to a fastening means nut (12CBAC), the fastening means shaft (12CBAB) slides in a stand base adjustment slot (12AA), the fastening means nut (12CBAC) is slidably constrained by a stand base adjustment slot counter bore (12AB), tightening the fastening means knob (12CBAA) functions to pull the fastening means nut (12CBAC) against the upper side of the stand base adjustment slot counter bore (12AB) which functions to secure the right bike support (12C) to the stand base (12A), loosening the fastening means knob (12CBAA) functions to release the fastening means nut (12CBAC) with respect to the upper side of the stand base adjustment slot counter bore (12AB) allowing the right bike support (12C) to be adjusted to accommodate different widths of bicycle rear wheels.

* * * * *